US008207808B2

(12) United States Patent
Yamada et al.

(10) Patent No.: US 8,207,808 B2
(45) Date of Patent: Jun. 26, 2012

(54) COIL COMPONENT

(75) Inventors: Satoru Yamada, Chuo-ku (JP); Yoshiyuki Hatayama, Chuo-ku (JP)

(73) Assignee: Sumida Corporation, Chuo-Ku, Tokyo (JP)

( * ) Notice: Subject to any disclaimer, the term of this patent is extended or adjusted under 35 U.S.C. 154(b) by 0 days.

(21) Appl. No.: 13/093,299

(22) Filed: Apr. 25, 2011

(65) Prior Publication Data

US 2011/0260821 A1 Oct. 27, 2011

(30) Foreign Application Priority Data

Apr. 27, 2010 (JP) ..... 2010-102674
Mar. 31, 2011 (JP) ..... 2011-080183

(51) Int. Cl.
*H01F 27/29* (2006.01)

(52) U.S. Cl. ..... 336/192

(58) Field of Classification Search ..... 336/65, 336/83, 192, 200, 232
See application file for complete search history.

(56) References Cited

U.S. PATENT DOCUMENTS 7,142,084 B2 * 11/2006 Cheng ..... 336/200
7,786,834 B2 * 8/2010 Yagasaki et al. ..... 336/192
2006/0049907 A1 * 3/2006 Liu ..... 336/200

FOREIGN PATENT DOCUMENTS

JP 2005-310869 A 11/2005

* cited by examiner

*Primary Examiner* — Tuyen Nguyen
(74) *Attorney, Agent, or Firm* — Buchanan Ingersoll & Rooney PC

(57) ABSTRACT

A coil component includes a core formed by a magnetic material, a coil embedded in the core, a part of a terminal portion of the coil protruded from a side surface of the core, and a tabular terminal, a part thereof protruded from the side surface of the core and partly connected with the protruded part of the terminal portion of the coil. The protruded part of the terminal portion of the coil and the protruded part of the tabular terminal are respectively bent toward the bottom surface side of the core along the side surface of the core, and the protruded and bent part of the terminal portion of the coil is arranged between the protruded and bent part of the tabular terminal and the core.

3 Claims, 11 Drawing Sheets

COIL COMPONENT

BACKGROUND OF THE INVENTION

1. Field of the Invention

The present invention relates to a coil component used in various electric appliances, electronic devices, etc.

2. Description of Related Art

Known coil components include the one in which a coil formed by winding a conductive wire is embedded in a magnetic core formed of a magnetic material, as described for example in the following Patent Document 1.

In the coil component described in Patent Document 1, a coil is embedded in a magnetic core, and lead-out wires of the coil protrude from side surfaces of the coil.

Also, parts of terminals of the coil component are embedded in the magnetic core, and remaining portions of the terminals similarly protrude from the side surfaces of the magnetic core. The terminals and the lead-out wires of the coil are overlapped to be connected with each other and thereby electrical continuity is established between the terminals and the coil.

According to Patent Document 1, it is described as that a magnetic core can be formed, without using an adhesive, by embedding a coil in the magnetic core formed by compression molding of powderized magnetic material whose surface has been covered by an insulating film and which has been mixed with a bonding material, and that heat resistance can be improved.

Patent Document 1: Japanese Unexamined Patent Application Publication No. 2005-310869

SUMMARY OF THE INVENTION

In the coil component described in the above-described Patent Document 1, a lead-out wire of a coil and a terminal of the coil component each protruded from a side surface of a magnetic core are bent along the side surface. In the process of bending the lead-out wire of the coil and the terminal, one method is to put a jig on the upper surface side of the terminal and thrust the jig downward to bend the terminal and the lead-out wire of the coil at the same time.

The lead-out wire of the coil is arranged on the upper surface side of the terminal before the lead-out wire and the terminal are bent and outward of the terminal in a condition that the lead-out wire and the terminal have been bent. Therefore, before the lead-out wire of the coil and the terminal are bent along the side surface of the core, the lead-out wire protrudes in the radial direction thereof from the upper surface of the terminal.

Then, when bending the terminal and the lead-out wire of the coil by putting a jig on the upper surface side of the terminal and thrusting the jig downward, the jig is put in line contact with the lead-out wire of the coil arranged on the upper surface side of the terminal. Accordingly, the thrusting force becomes unstable in the applied direction, so that it is difficult to ensure high accuracy in bending the terminal and the lead-out wire of the coil, and variation is caused in overall size of the coil component after the terminal and the lead-out wire of the coil have been bent.

In the above-described Patent Document 1, a groove is provided in the terminal, and the lead-out wire of the coil is arranged in the groove.

On the other hand, it is preferable to perform crushing work to the lead-out wire of the coil for realizing good contact between the terminal and the lead-wire of the coil. However, if variation is present in crushing work to the lead-out wire of the coil, there is a fear that the lead-out wire of the coil gets out of the groove. If the lead-out wire of the coil gets out of the groove, the portion of the coil component where the lead-out wire of the coil has gotten out of the groove becomes a most-protruded portion in the side surface of the coil component, so that in this case also, variation is caused in the overall size of the coil component.

Further, when bending the terminal of the coil component, the lead-out wire of the core gotten out of the groove and a thrusting jig are put in line contact with each other, so that bending accuracy decreases, and accordingly, variation tends to occur in the overall size of the coil component.

Therefore, it is necessary to perform crushing work for the lead-out wire of the coil uniformly with high accuracy, which leads to difficulty in work and increase in cost.

The present invention has been made in view of the above-described problems, and aims to provide a coil component in which bending of a terminal and a lead-out wire of a coil is relatively easy, and variation in the overall size of the coil component is suppressed.

To solve the above-described problems, a coil component according to the present invention includes a core formed of a magnetic material; a coil embedded in the core, a part of a terminal portion of the coil protruded from a side surface of the core; and a tabular terminal, apart of which protruded from the side surface of the core and partly connected with the terminal portion of the coil. The protruded part of the terminal portion of the coil and the protruded part of the tabular terminal are respectively bent toward the bottom surface side of the core along the side surface of the core, and the protruded and bent part of the terminal portion of the coil is arranged between the protruded and bent part of the tabular terminal and the core.

In the coil component of the present invention, the protruded and bent part of the terminal portion of the coil is arranged between the protruded and bent part of the tabular terminal and the core. That is, at the time the protruded part of the tabular terminal and the protruded part of the terminal portion of the coil are bent along the side surface of the core, the protruded part of the terminal portion of the coil is arranged on the surface of the protruded part of the tabular terminal on the side opposite to the surface a thrusting jig contacts for bending.

Thus, the protruded part of the terminal portion of the coil will not be arranged on the front side surface of the protruded part of the tabular terminal, which is the surface the thrusting jig contacts, so that the surface the thrusting jig contacts is a flat surface.

Accordingly, regardless of accuracy in crushing work for the terminal portion of the coil, it is possible to reliably bring the protruded part of the tabular terminal and the thrusting jig into surface contact.

Further, it is preferable to provide a cutout in an end portion of the tabular terminal on the side to be embedded in the core so as to extend into the protruded and bent part thereof and to be partly exposed from the side surface of the core. And, the terminal portion of the coil is arranged such that at least a part thereof fits in the part of the cutout of the tabular terminal exposed from the side surface of the core.

Thereby, it is possible to put the protruded part of the terminal portion of the coil in a condition of being separated at the bending position thereof from the protruded part of the tabular terminal. Therefore, strain, which is caused in the protruded part of the terminal portion of the coil when the protruded part of the terminal portion of the coil and the protruded part of the tabular terminal are bent along the side surface of the core, is avoided, and accuracy in bending the protruded part of the tabular terminal and the protruded part of the terminal portion of the coil along the side surface of the coil can be enhanced.

Furthermore, it is preferable to provide a groove for accommodating the protruded and bent part of the terminal portion of the coil in the side surface of the core from which the terminal portion of the coil protrudes. Thereby, it is possible to accommodate the protruded and bent part of the terminal portion of the coil arranged between the protruded and bent part of the tabular terminal and the core on the inner side of the side surface of the core.

Accordingly, after the protruded part of the tabular terminal and the protruded part of the terminal portion of the coil have been bent along the side surface of the core, only the tabular terminal protrudes by the thickness thereof from the side surface of the core. Therefore, the overall size of the coil component is determined, regardless of the accuracy in crushing work for the terminal portion of the coil, based only on the core and the protruded and bent part of the tabular terminal extending along the side surface of the core, and it is possible to improve accuracy in the overall size of the coil component.

According to the present invention, a part of a tabular terminal protruded from a side surface of a core and a thrusting jig for bending the protruded part of the tabular terminal along the side surface of the core can be reliably brought into surface contact . Therefore, it is possible to bend the protruded part of the tabular terminal and a part of a terminal portion of the coil protruded from the side surface of the core along the side surface of the core with accuracy, and a coil component having satisfactory accuracy in the overall size can be provided.

DESCRIPTION OF PREFERRED EMBODIMENTS

Herein below, description will be made with respect to coil components according to embodiments of the present invention based on FIG. 1 through FIG. 10, however, the present invention is not limited to examples below. Description will be made in the order below.

1. First Embodiment
   1-1. Constitution of Coil Component
   1-2. Production Method of Coil Component
   2. Second Embodiment
   3. Third Embodiment 1. First embodiment 1-1. Constitution of Coil Component First, using FIG. 1 through FIG. 5, description is made with respect to a constitution of a coil component according to the first embodiment.

Figure 1:
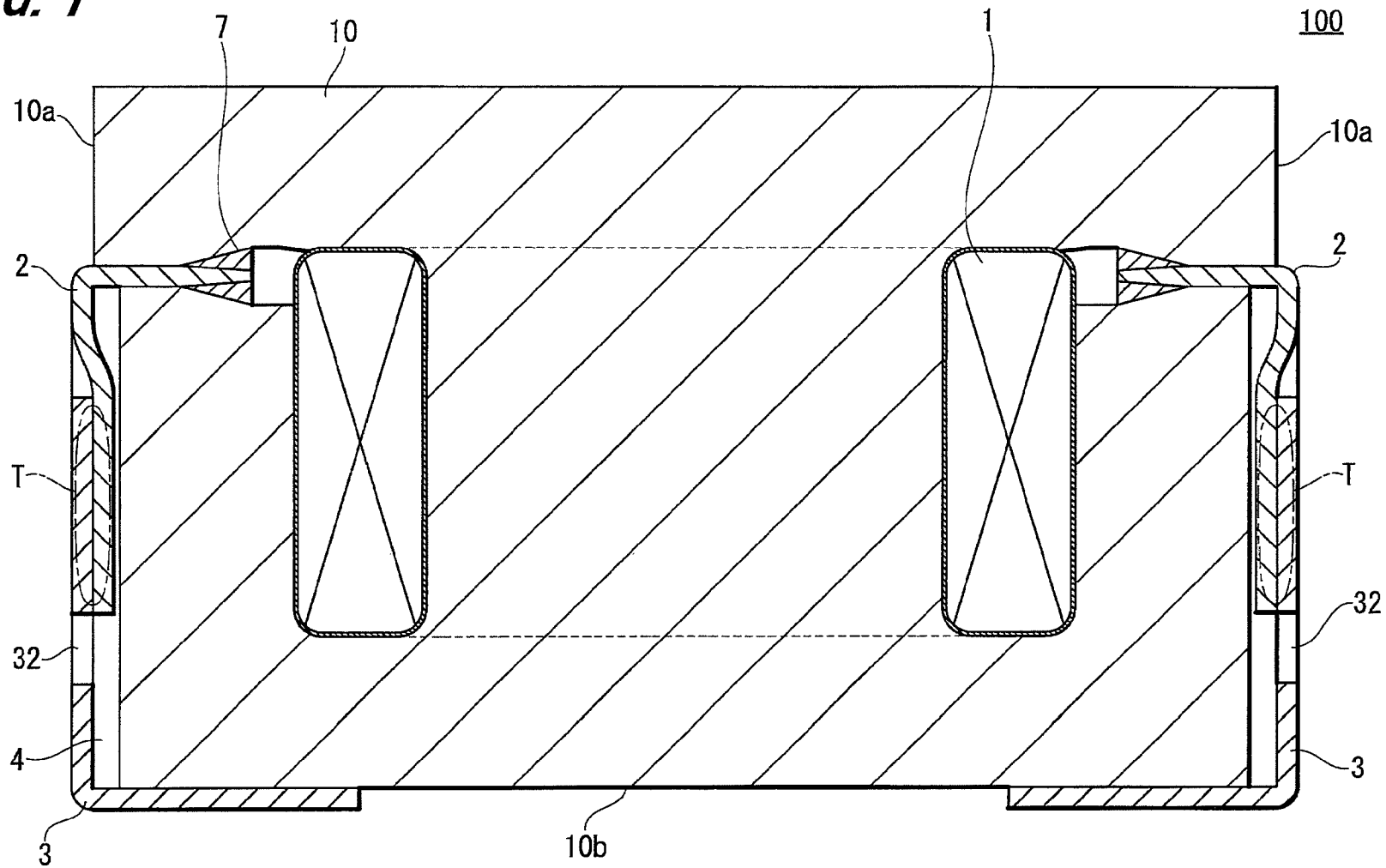
FIG. 1 is a schematic cross section illustrating a constitution of a coil component according to a first embodiment of the present invention.
Figure 2:
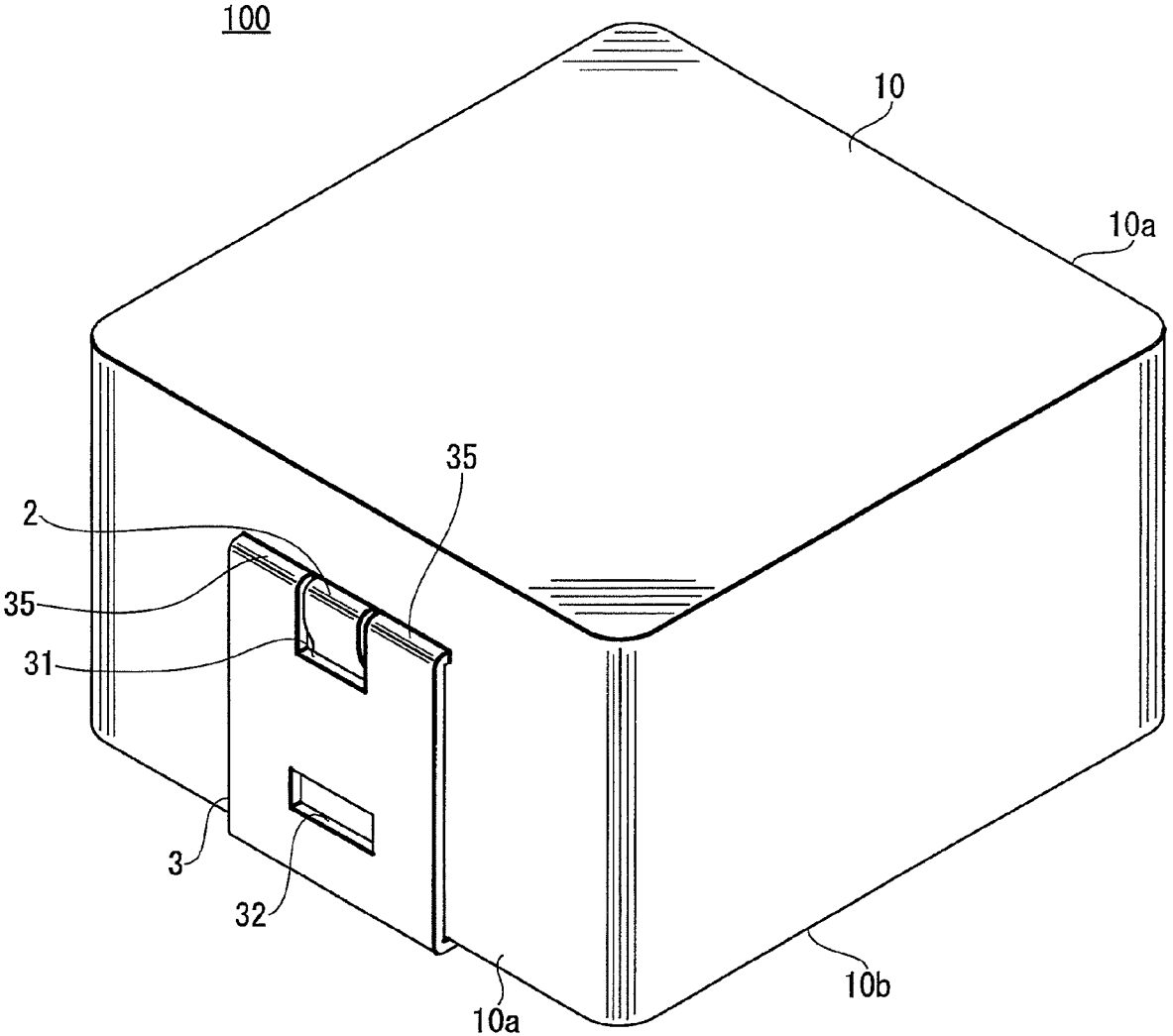
FIG. 2 is a perspective view of the coil component according to the first embodiment of the present invention.
Figure 3:
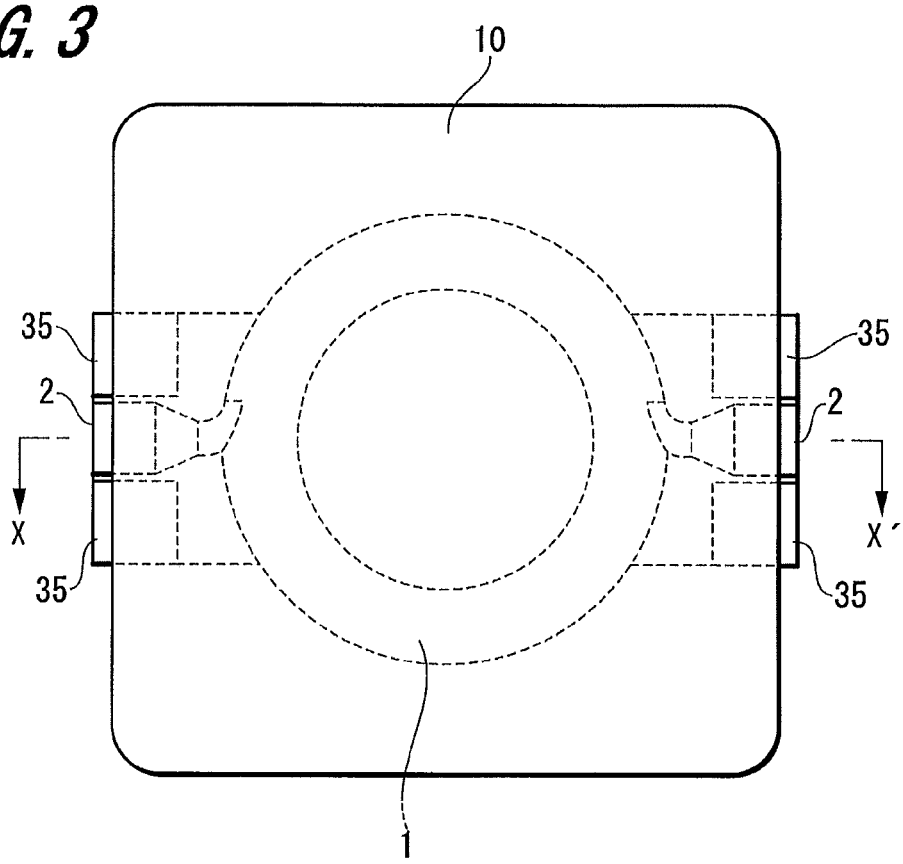
FIG. 3 is a top view of the coil component according to the first embodiment of the present invention.
Figure 4:
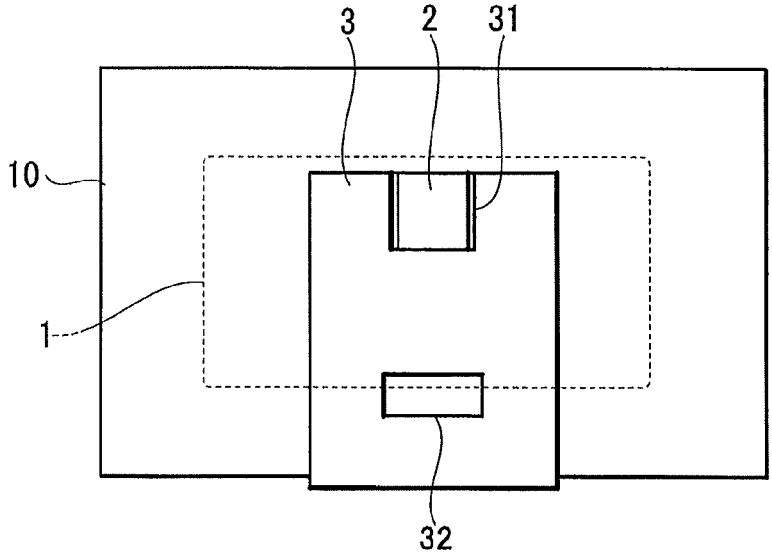
FIG. 4 is a side view of the coil component according to the first embodiment of the present invention.
Figure 5:
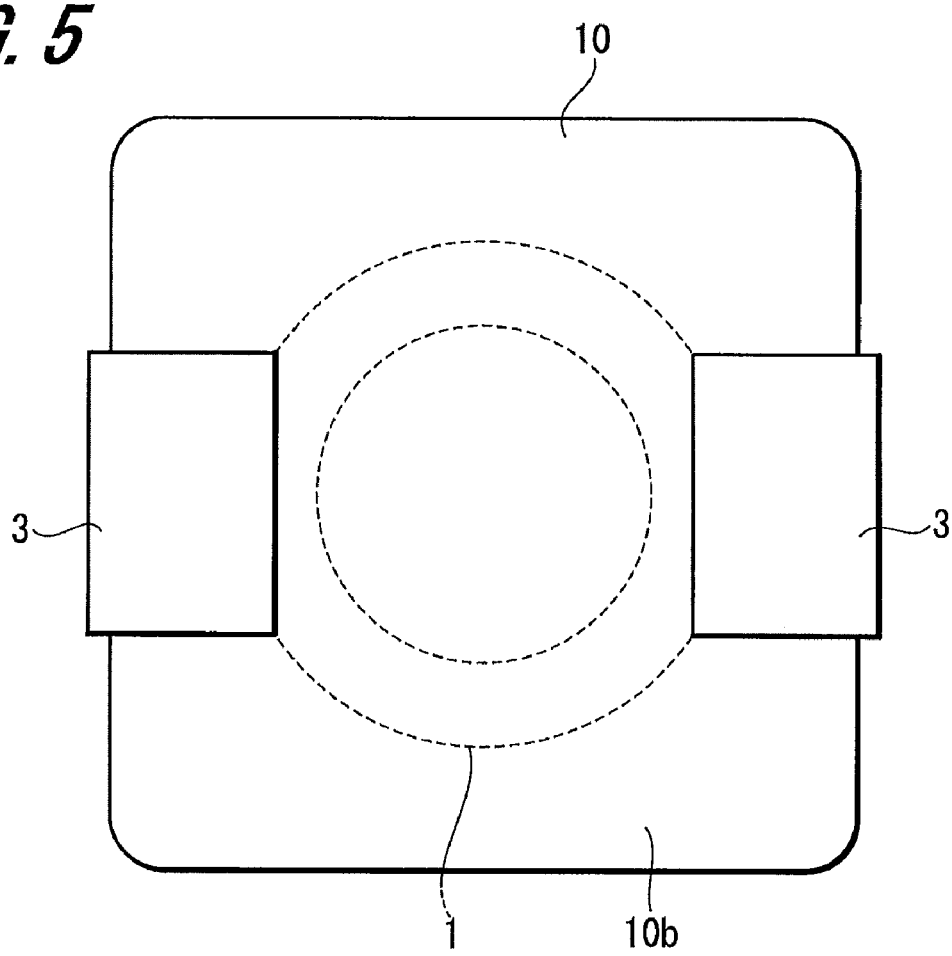
FIG. 5 is a bottom view of the coil component according to the first embodiment of the present invention.

FIG. 1 is a cross section of a coil component 100 according to the present embodiment. FIG. 2 is a perspective view, FIG. 3 is a top view, FIG. 4 is a side view, and FIG. 5 is a bottom view. Note that FIG. 1 shows a cross section at X-X' of FIG. 3.

The coil component 100 according to the present embodiment includes, as illustrated in FIG. 1, a magnetic core 10 made of a magnetic material for example, a coil 1 embedded in the core 10, and a terminal 3 connected with a coil terminal 2 of the coil 1.

The magnetic material constituting the core 10 is not limited here in particular, and for example, Mn—Zn ferrite, Ni—Zn ferrite, sendust alloy, permalloy, etc. are given. The core 10 is formed by pressure molding and baking granulation powder in which the magnetic material as described above and a thermosetting resin material (for example, epoxy resin, etc.) have been mixed.

The coil 1 is formed by winding a round or rectangular conductive wire. The coil 1 is embedded in the core 10, and parts of two coil terminal portions 2 of the conductive wire forming the coil 1 protrude from two opposing side surfaces 10*a* of the core 10 to the outside of the core 10, respectively. Note that at the part of each of the coil terminal portions 2 protruded outside of the core 10, an insulating film 7 covering the conductive wire is removed, and the conductive wire made of a copper material, etc. is exposed. Here, the case of using the round conductive wire is illustrated, and in this case, the coil terminal portion 2 is worked so as to be in a flat shape by crushing work.

The coil terminal portion 2 is connected with a tabular terminal 3 on the outside of the core 10. The terminal 3 is provided with a cutout 31, and protruded terminal parts 35 at both ends of the cutout 31 are partly embedded in the core 10, as illustrated in FIG. 2 and FIG. 3. The part of the terminal 3 protruded from a side surface 10*a* of the core 10 is bent downward along the side surface 10*a* of the core 10, and further bent, as illustrated in FIG. 1 and FIG. 5, along a bottom surface 10*b* of the core 10 at a ridge line of the side surface 10*a* and the bottom surface 10*b*.

As illustrated in FIG. 2 and FIG. 3, the coil terminal portion 2 is partly arranged in the cutout 31 of the terminal 3, and the part of the coil terminal portion 2 protruded from the side surface 10*a* of the core 10 and partly located in the cutout 31 is bent downward along the side surface 10*a* of the core 10. At this time, the part of the coil terminal portion 2 continuing from the part located in the part of the cutout 31 exposed outside of the core 10 is arranged on the back side of the terminal 3, as illustrated in FIG. 1 in a region T, and the coil terminal portion 2 of the coil 1 is connected with the terminal 3 at the part of the coil terminal portion 2 arranged on the back side of the terminal 3. That is, the part of the coil terminal portion 2 protruded from and bent along the side surface 10*a* of the core 10 is partly arranged between the part of the terminal 3 protruded from and bent along the side surface 10*a* and the core 10.

Also, as illustrated in FIG. 1, FIG. 2, and FIG. 4, a cutout hole 32 is opened in the terminal 3, and the coil terminal portion 2 extends to an upper end of the cutout hole 32.

Thus, in the coil component 100 according to the present embodiment, the part of the coil terminal portion 2 protruded from and bent along the side surface 10*a* of the core 10 is arranged on the back side of the part of the terminal 3 protruded from and bent along the side surface 10*a* of the core 10, that is, as illustrated in FIG. 1, between the part of the terminal 3 protruded from and bent along the side surface 10*a* of the core 10 and the core 10. Accordingly, the part of the coil terminal portion 2 protruded from and bent along the side surface 10*a* of the core 10 is not arranged on the outermost surface of the coil component 100. Thus, the outermost surface of the coil component 100 is the surface of the part of the terminal 3 protruded from and bent along the side surface 10*a* of the core 10, so that regardless of crushing work accuracy for the coil terminal portion 2, the outer shape of the coil component 100 can be made uniform.

Also, after the core 10 and the coil 1 have been integrally molded with a part of the terminal 3 embedded therein as described later, in a condition that a part of the coil terminal portion 2 and a part of the terminal 3 are protruded in the outer circumferential direction of the core 10, the coil terminal portion 2 is arranged on the side of the direction in which the terminal 3 is bent (i.e. , on the back side of the terminal 3).

Therefore, when bending the protruded part of the terminal 3 along the side surface 10*a* of the core 10, a thrusting jig and the surface of the protruded part of the terminal 3 can be brought in surface contact.

Accordingly, it becomes possible to apply a uniform force stably in the same direction. Therefore, high accuracy can be realized in bending the protruded part of the coil terminal portion 2 and the protruded part of the terminal 3 along the side surface 10*a* of the core 10, and variation in the overall size of the coil component 100 can be decreased.

In the present embodiment in particular, the cutout 31 is provided in the terminal 3, and a part of the coil terminal portion 2 is arranged in the cutout 31. And, the terminal 3 is bent along the side surface 10*a* of the core 10 at the part where the cutout 31 is provided, and the coil terminal portion 2 is bent as well along the side surface 10*a* of the core 10 at the part arranged in the cutout 31.

Here, a case is examined that the terminal 3 and the coil terminal portion 2 arranged on the back side of the terminal 3 are not fixed to each other by soldering, etc. , and the cutout 31 is not provided in the terminal 3.

In this case, if the terminal 3 and the coil terminal portion 2 are bent together, the terminal 3 is bent while sliding on the coil terminal portion 2. At this time, because of difference between the bend diameter of the terminal 3 and the bend diameter of the coil terminal portion 2, displacement is caused between the terminal 3 and the coil terminal portion 2 by the thickness (diameter) of the coil terminal portion 2.

On the other hand, when the coil terminal portion 2 and the terminal 3 are connected to each other and fixed, for example by soldering, etc., as in the region T in FIG. 1, the above-described displacement between the terminal 3 and the coil terminal portion 2 will not occur, however, there is a fear that a strain equivalent to the above-described displacement between the coil terminal portion 2 and the terminal 3 is caused in the coil terminal portion 2.

If such strain is caused in the coil terminal portion 2, there is a fear that the surface of the terminal 3 after having been bent is not put in parallel with the side surface 10*a* of the core 10, and is strained for example obliquely, or the bending position of the terminal 3 will be departed, and that variation is caused in the overall size of the coil component 100.

In contrast, in the coil component 100 according to the present embodiment, the cutout 31 is provided in an end portion of the terminal 3 on the side to be embedded in the core 10. A part of the coil terminal portion 2 is arranged in the cutout 31, and the part of the terminal 3 protruded from the side surface 10*a* of the core 10 is bent along the side surface 10*a* of the core 10 at the part where the cutout 31 is provided and the part of the coil terminal portion 2 protruded from the side surface 10*a* of the core 10 is bent as well along the side surface 10*a* of the core 10 at the part arranged in the cutout 31. Therefore, the coil terminal portion 2 does not contact the terminal 3 at the bending position thereof.

Thus, when the part of the terminal 3 protruded from the side surface 10*a* and the part of the coil terminal portion 2 protruded from the side surface 10 are bent, the strain in the coil terminal portion 2 equivalent to the above-described displacement between the terminal 3 and the coil terminal portion 2 can be freed at the cutout 31, so that it becomes possible to accurately bend the part of the terminal 3 protruded from the side surface 10*a* and the part of the coil terminal portion 2 protruded from the side surface 10*a* along the side surface 10*a*. Accordingly, variation in the shape of outermost surfaces of the coil component 100 can be reduced, and thereby accuracy in the overall size of the coil component 100 can be improved.

Further, because an effect of reducing strain can be produced only if the coil terminal portion 2 is not in contact with the terminal 3 at least at the bending position thereof, it is sufficient if the coil terminal portion 2 is arranged such that a part thereof fits in the part of the cutout 31 of the terminal 3 exposed from the side surface 10*a* of the core 10.

Here, the part of the coil terminal portion 2 protruded from and bent along the side surface 10*a* is in contactless with the part of the terminal 3 protruded from and bent along the side surface 10*a* at the bending position thereof by providing in the terminal 3 the cutout 31 in a shape that one of the ends is opened, and the part of the protruded and bent part of the coil terminal portion 2 continuing from the part located in the cutout 31 is arranged between the protruded and bent part of the terminal 3 and the core 10.

However, because it is only necessary that the coil terminal portion 2 is in contactless with the terminal 3 at the bending position thereof, the shape of the cutout 31 is not necessarily required to be the one in which one of the ends is opened. For example, it may be configured such that an opening is provided in the terminal 3 and the opening is arranged in the vicinity of the bending position of the coil terminal portion 2.

Further, it is preferable to arrange the coil terminal portion 2 and the terminal 3 so as to protrude toward the outside of the core 10 from substantially the same position in height of the side surface 10*a* of the core 10. As the positions in height where a part of the coil terminal portion 2 and a part of the terminal 3 protrude from the side surface 10*a* of the core 10 respectively are closer to each other, the above-described displacement between the terminal 3 and the coil terminal portion 2 can be made smaller. Therefore, the strain caused in the coil terminal portion 2 when the terminal 3 and the coil terminal portion 2 are bent along the side surface 10*a* of the core 10 can be further reduced, and bending accuracy can be improved, which is preferable.

Particularly, when the positions in height where a part of the coil terminal portion 2 and a part of the terminal 3 respectively protrude from the side surface 10*a* of the core 10 are made the same, the above-described displacement between the terminal 3 and the coil terminal portion 2 becomes zero, so that strain will not be caused in the coil terminal portion 2, and the part of the coil terminal portion 2 protruded from the side surface 10*a* and the part of the terminal 3 protruded from the side surface 10*a* can be bent more reliably.

In this case, it is preferable that the cutout 31 with the shape that one end is opened is provided in the terminal 3. With provision of the cutout 31 with the shape that one end is opened in the terminal 3, inside the core 10 also the coil terminal portion 2 can be arranged on the same plane with the terminal 3 in the cutout 31. Therefore, it is possible to cause the coil terminal portion 2 and the terminal 3 to protrude from the side surface 10*a* of the core 10 easily at the same position in height .

Note that it is preferable to provide a groove 4 for accommodating the part of the coil terminal portion 2 protruded from and bent along the side surface 10*a* of the core 10, in the side surface 10*a* of the core 10 below the protruded part of the coil terminal portion 2 as illustrated in FIG. 1. With provision of the groove 4 in the side surface 10*a* of the core 10, the part of the coil terminal portion 2 protruded from and bent along the side surface 10*a* of the core 10 can be accommodated on the inward side of the side surface 10*a* of the core 10. By making the depth of the groove 4 deeper than the thickness of the coil terminal portion 2, after the part of the coil terminal portion 2 protruded from the side surface 10*a* and the part of the terminal 3 protruded from the side surface 10*a* have been bent along the side surface 10*a*, only the terminal 3 protrudes from the side surface 10*a* of the core 10 by the thickness thereof, so that the coil component 100 can be downsized. Also, because the part of the terminal 3 protruded from and bent along the side surface 10*a* of the core 10 and the core 10 are in surface contact, the terminal 3 can be stably fixed to the core 10.

Further, because the overall size of the coil component 100 is determined, regardless of crushing work accuracy for the coil terminal portion 2, based only on the core 10 and the part of the terminal 3 protruded from and bent along the side surface 10*a* of the core 10, it becomes possible to realize stable narrow tolerance.

Also, when the groove 4 is not provided, after the part of the coil terminal portion 2 protruded from the side surface 10*a* and the part of the terminal 3 protruded from the side surface 10*a* have been bent along the side surface 10*a*, only the coil terminal portion 2 and the terminal 3 protrude from the side surface 10*a* of the core 10 by thicknesses thereof. However, because the coil terminal portion 2 is subjected to crushing work, if there is a variation in accuracy of crushing work for the coil terminal portion 2, the height of the coil terminal portion 2 protruding from the side surface 10*a* of the core 10 also varies, so that there is a possibility that the overall size of the coil component 100 is affected.

However, by providing the groove 4 in the side surface 10*a* of the core 10 and accommodating the part of the coil terminal portion 2 protruded from and bent along the side surface 10*a* in the groove 4 as in the present embodiment, it is possible to provide a stable overall size of the coil component 100 regardless of the accuracy in crushing work for the coil terminal portion 2.

As described above, in the coil component 100 of the present embodiment, the part of the coil terminal portion 2 protruded from and bent along the side surface 10*a* of the core is arranged between the part of the terminal 3 protruded from and bent along the side surface 10*a* and the core 10. Therefore, when bending the protruded part of the coil terminal portion 2 and the protruded part of the terminal 3 along the surface 10*a* of the core 10, a bending jig can be reliably brought into surface contact with the protruded part of the terminal 3.

Thereby, a stable force can be applied in the same direction, so that accuracy in bending the protruded part of the terminal 3 and the protruded part of the coil terminal portion 2 along the side surface 10*a* of the core 10 can be improved, and it is possible to provide the coil component 100 that is stable in overall size.

1-2. Production Method of Coil Component

Next, description will be made below referring to FIG. 6 through FIG. 8 with respect to a production method for the coil component 100 according to the present embodiment.

Figure 6:
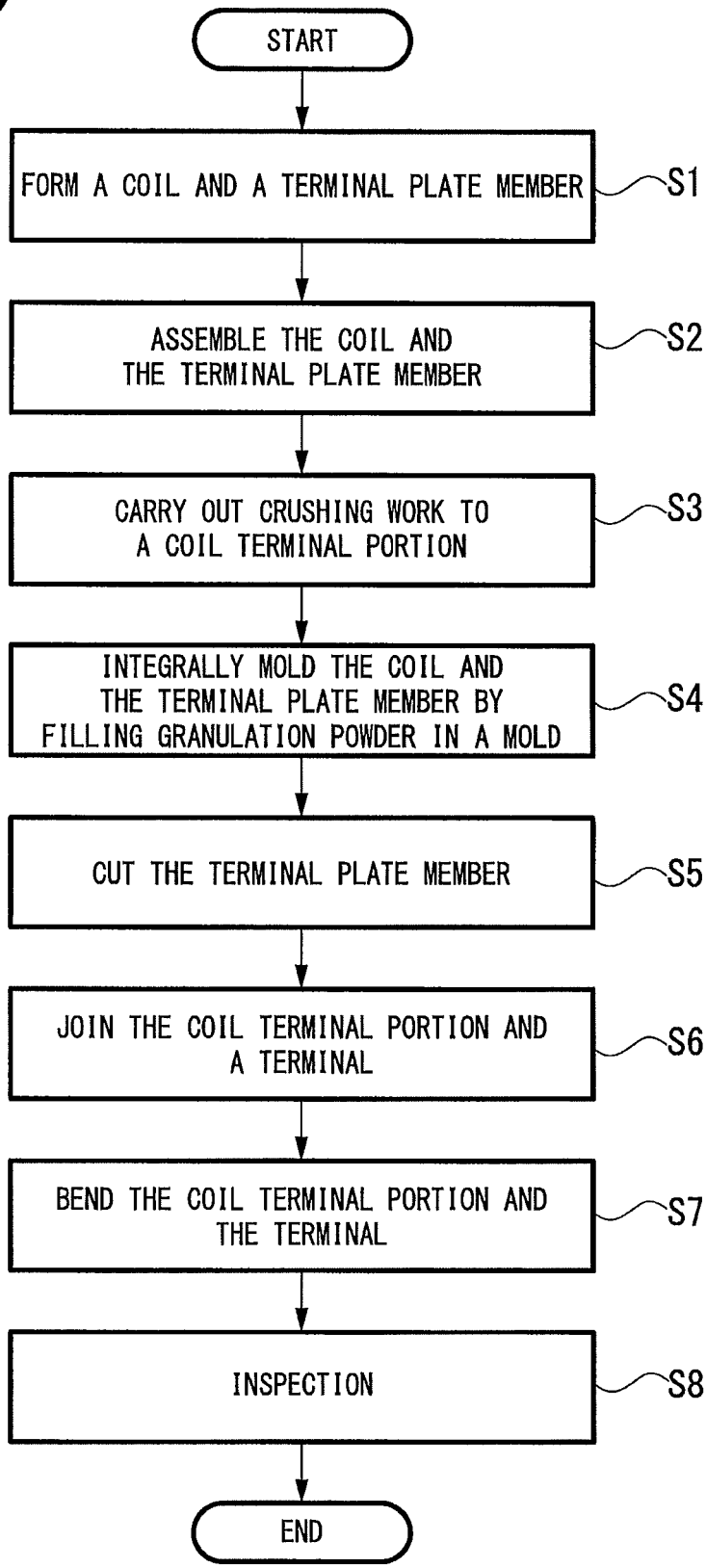
FIG. 6 is a flowchart illustrating a production method of the coil component according to the first embodiment of the present invention.

FIG. 6 is a flowchart illustrating an example of a production method for the coil component 100 according to the present embodiment.

Figure 7A:
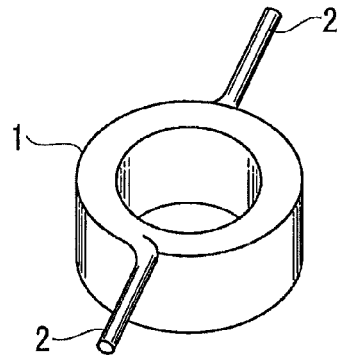
FIG. 7A, FIG. 7B, FIG. 7C, and FIG. 7D are explanatory diagrams illustrating a production process of the coil component according to the first embodiment of the present invention.
Figure 7B:
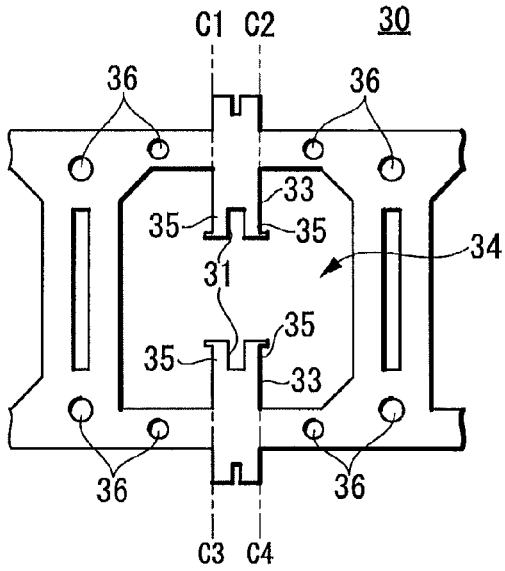

First, the coil 1 illustrated for example in FIG. 7A is formed by winding a conductive wire, which has been formed by covering around a copper material with an insulating film a predetermined number of times. At this time, two coil terminal portions 2 are drawn out. Further, a terminal plate member 30 illustrated in FIG. 7B is formed by punching a conductive member in the shape of a thin flat plate (e.g., metal, etc.) with a press machine for example (step S1).

The terminal plate member 30 is formed in a hoop-like shape by opening a coil arrangement hole 34 in the conductive member in the shape of a thin flat plate.

Also, positioning holes 36 are opened in a frame portion of the terminal plate member 30, and the terminal plate member 30 is subjected to punching work with a press machine, with the terminal plate member 30 fixed by causing protrusions arranged on a pedestal, etc . of the press machine to fit in the positioning holes 36.

In the coil arrangement hole 34, two terminal formation parts 33 are formed, protruding toward the center of the coil arrangement hole 34 and opposing each other. At a tip of each terminal formation part 33, the cutout 31 is formed, and thereby the protruding terminal parts 35 are formed at both sides of the cutout 31.

Figure 7C:
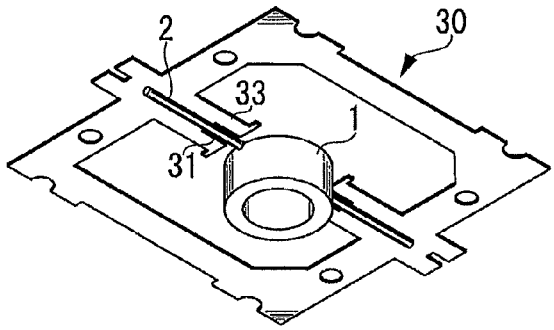

Then, as illustrated in FIG. 7C, the coil 1 and the terminal plate member 30 are assembled with the coil 1 arranged between these two opposing terminal formation parts 33 (step S2). The coil terminal portion 2 of the coil 1 is arranged, while passing over the cutout 31, in the center of the terminal formation part 33 so as to roughly divide the terminal formation part 33 in half.

Figure 7D:
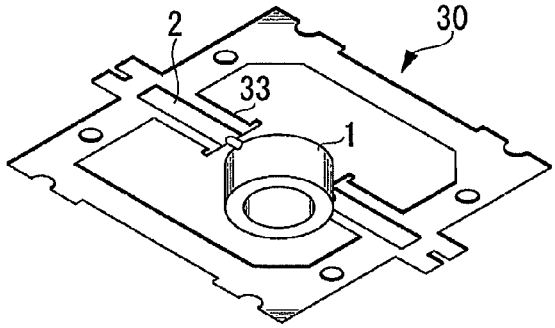

Then, as illustrated in FIG. 7D, crushing work is carried out to the coil terminal portions 2 by applying pressure for example with a press machine, a jig, etc. (step S3) . Thereby, each of the coil terminal portions 2 is processed into a flat shape, and it becomes easier to connect the coil terminal portion 2 with the terminal 3 in a subsequent process.

Note that here an example has been illustrated that crushing work is carried out to the coil terminal portions 2 after arranging the coil 1 on the terminal plate member 30, however, the coil 1 in which crushing work has been previously carried out to the coil terminal portions 2 may be arranged on the terminal plate member 30.

Figure 8A:
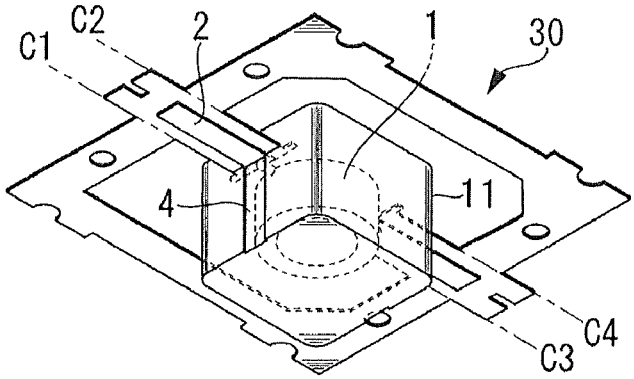
FIG. 8A, FIG. 8B and FIG. 8C are another explanatory diagrams illustrating a production process of the coil component according to the first embodiment of the present invention.

Next, the coil 1 and the terminal plate member 30 are arranged in a mold, and granulation powder including magnetic material, thermo-setting resin, etc. are filled in the mold. And, as illustrated in FIG. 8A, a green compact 11 is formed by pressing (step S4). At this time, parts of the protruding terminal parts 35 of the terminal formation part 33 are embedded in the green compact 11. The groove 4 is formed in the side surface of the green compact 11 from which a part of the coil terminal portion 2 protrudes, downward from the protrusion position of the coil terminal portion 2.

Figure 8B:
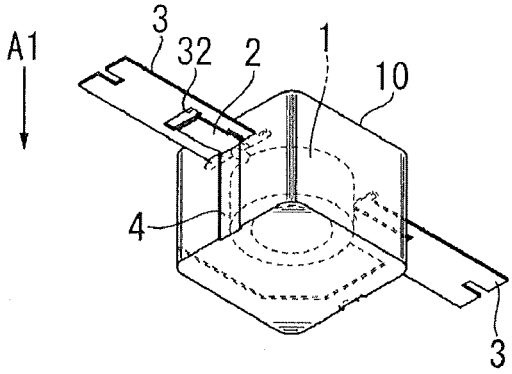

Then, as illustrated in FIG. 8B, the core 10 is formed by heat-hardening the green compact 11. Further, the frame portions of the terminal plate member 30 are cut along lines C1, C2, C3 and C4 with a press machine, etc., and the terminal 3 in the shape of a flat plate is formed (step S5). At this time, by providing the cutout hole 32 at the same time by pressing, the coil terminal portion 2 maybe cut such that the tip thereof is aligned with the end of the cutout hole 32 on the side of the core 10.

Then, dust-proof finish is provided to the surface of the core 10, and the terminal 3 and the coil terminal portion 2 are connected with each other for example by soldering, welding, etc. (step S6) .

Figure 8C:
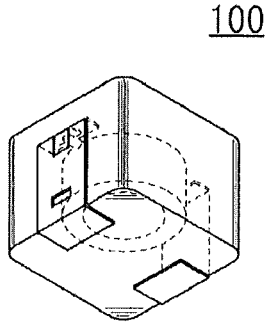

Finally, using a jig, etc, the part of the terminal 3 protruded from the side surface 10*a* is thrust in the direction of an arrow Al, and thereby the part of the terminal 3 protruded from the side surface 10*a* and the part of the coil terminal portion 2 protruded from the side surface 10*a* are bent along the side surface 10*a* of the core 10 (step S7) . Also, the part of the terminal 3 protruded from the side surface 10*a* is further bent, at the ridge line of the side surface 10*a* and the bottom surface of the core 10, along the bottom surface of the core 10. Thereby, as illustrated in FIG. 8C, the coil component 100 is completed, which is then shipped after an inspection process (step S8).

Note that the production process is not limited to the above-described example, and it is possible to change the processing order as appropriately, for example, to carry out the crushing work carried to the coil terminal portion 2 in step S3, in step 1.

In the present embodiment, as illustrated in FIG. 8B also, the part of the coil terminal portion 2 protruded from the side surface of the core 10 is arranged on the back side of the part of the terminal 3 protruded from the side surface of the core 10. Accordingly, when bending the part of the terminal 3 protruded from the side surface of the core 10 along the side surface of the core 10, it is possible to surely bring a jig and a surface of the terminal 3 into surface contact, so that it is possible to apply a force uniformly in the same direction in a stable manner to thrust the part of the terminal 3 protruded from the side surface of the coil 10 in the direction of the arrow A.

Therefore, the part of the terminal 3 protruded from the side surface of the core 10 can be bent along the side surface of the core 10 with accuracy, so that variation in the overall size of the coil component 100 can be reduced.

Further, because the groove 4 is formed in the side surface of the core 10, the part of the coil terminal portion 2 protruded from and bent along the side surface of the core 10 can be accommodated in the groove 4. Thereby, only the terminal 3 protrudes from the side surface of the core 10 by the thickness thereof regardless of crushing work accuracy for the coil terminal portion 2. Therefore, it is possible to further enhance the accuracy in the overall size of the coil component 100, and the coil component 100 can be downsized also.

Furthermore, the cutout 31 is provided in the terminal 3 as described above, and the coil terminal portion 2 is arranged while passing over the cutout 31. Therefore, the part of the coil terminal portion 2 located over the cutout 31 does not contact the terminal 3, so that strain caused in the part of the coil terminal portion 2 protruded from the side surface of the coil 10 when the protruded part of the coil terminal portion 2 and the protruded part of the terminal 3 are bent along the side surface of the core 10 can be avoided. Accordingly, the accuracy in bending the protruded part of the coil terminal portion 2 and the protruded part of the terminal 3 along the side surface of the core 10 and the accuracy in the overall size of the coil component 100 can be further enhanced.

2. Second Embodiment

Next, description will be made below referring to FIG. 9 and FIG. 10 with respect to a coil component according to the second embodiment of the present invention.

Figure 9:
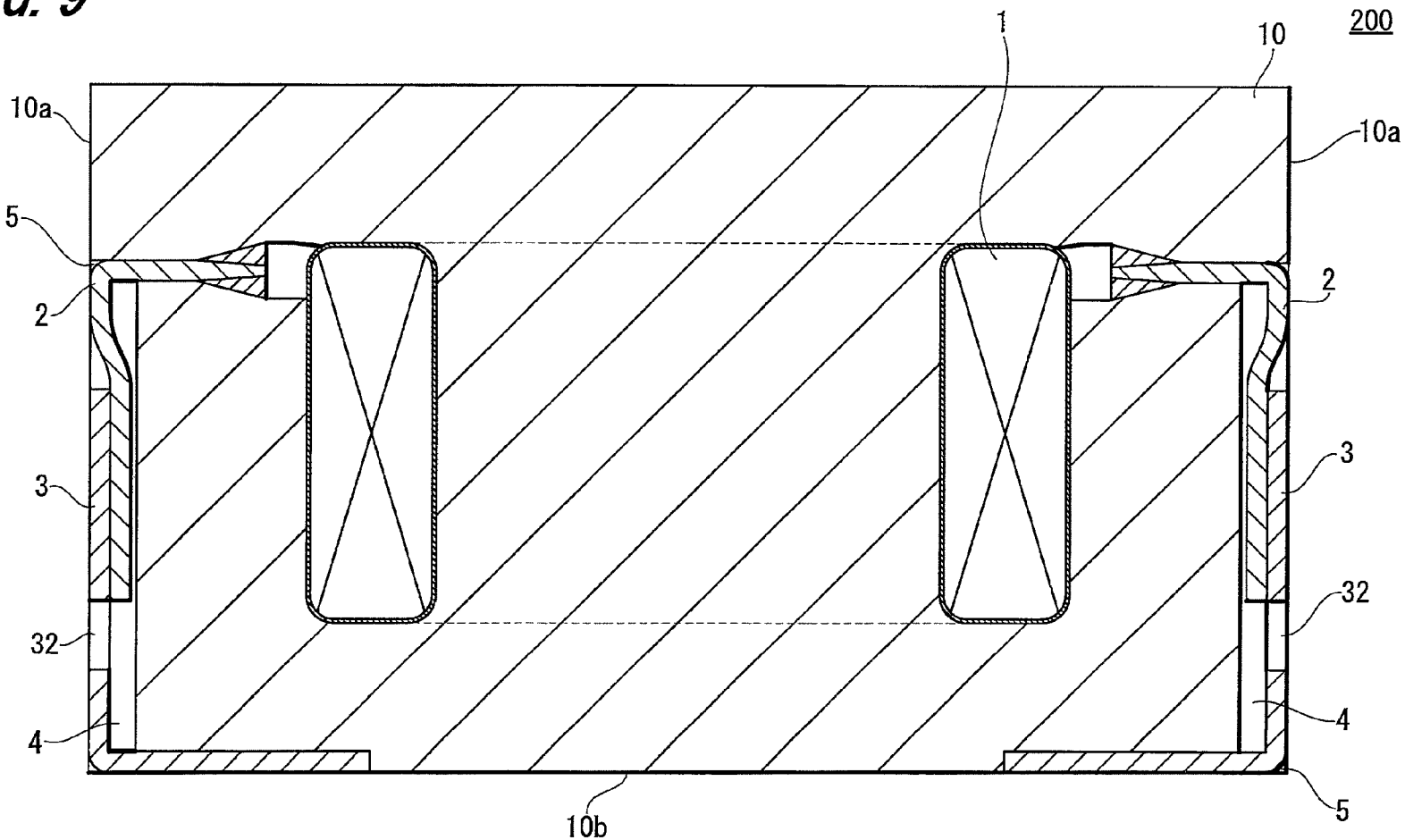
FIG. 9 is a schematic cross section illustrating a constitution of a coil component according to a second embodiment of the present invention.

FIG. 9 is a schematic cross section illustrating a constitution of a coil component 200 according to the second embodiment. Note that parts corresponding to those in the first embodiment (FIG. 1 through FIG. 5) are denoted with the same symbols, and description thereof is omitted.

The coil component 200 according to the second embodiment includes the coil 1 in which for example a round or flat rectangular conductive wire has been wound, the core 10 formed of a magnetic material and embedding therein the coil 1, and the terminal 3 connected with the coil terminal portion 2 of the coil 1.

A part of the coil terminal portion 2 is arranged outside of the core 10 and is bent downward along the side surface 10*a* of the core 10. The terminal 3 in a shape of a flat plate is partly embedded in the core 10 through the side surface 10*a* of the core 10, and is bent downward outside of the core 10 along the side surface 10*a* of the core 10.

In the present embodiment also, as illustrated in FIG. 9, the part of the coil terminal portion 2 arranged outside of the core 10 is partly arranged on the back side of the part of the terminal 3 protruded from and bent along the side surface 10*a* of the core 10, that is, between the part of the terminal 3 bent along the side surface 10*a* of the core 10 and the side surface 10*a* of the core 10. And, the part of the coil terminal portion 2 arranged on the back side of the terminal 3 are connected with the terminal 3 on the back side of the terminal 3.

Further, the cutout hole 32 may be provided in the terminal 3, and the tip of the coil terminal portion 2 may be aligned with the upper end of the cutout hole 32, as in the first embodiment.

Accordingly, as in the first embodiment, the part of the coil terminal portion 2 protruded from the side surface 10*a* of the core 10 is not arranged on the upper surface side of the terminal 3, so that when bending the protruded part of the terminal 3 and the protruded part of the coil terminal portion 2 along the side surface 10*a* of the core 10, it is possible to reliably bring a jig and the protruded part of the terminal 3 into surface contact.

Therefore, it becomes possible to apply a stable force in the same direction, and the part of the terminal 3 protruded from the side surface 10*a* of the core 10 and the part of the coil terminal portion 2 protruded from the side surface 10*a* of the core 10 can be accurately bent along the side surface 10*a* of the core 10. Accordingly, the variation in the shape of outermost surfaces of the coil component 200 can be decreased, and the accuracy in the overall size of the coil component 200 can be improved.

In the present embodiment also, a cutout is provided in the terminal 3 starting from the part thereof embedded in the core 10 to the part thereof protruded outside of the core 10. The coil terminal portion 2 is arranged such that a part thereof is arranged in the cutout and the part continuing from the part arranged in the cutout is then arranged on the back side of the terminal 3, i.e. , between the part of the terminal 3 bent along the side surface 10*a* of the core 10 and the side surface 10*a* of the core 10.

The part of the coil terminal portion 2 arranged in the cutout of the terminal 3 is not in contact with the terminal 3, so that it is possible to avoid strain, which is caused in the coil terminal portion 2 when the part of the terminal 3 protruded from the side surface 10*a* of the core 10 and the part of the coil terminal portion 2 protruded from the side surface 10*a* of the core 10 are bent along the side surface 10*a* of the core 10, as in the first embodiment. Accordingly, it can be avoided that a burden is given to the connection of the coil terminal portion 2 and the terminal 3, and also the accuracy in bending the protruded part of the terminal 3 and the protruded part of the coil terminal portion 2 along the side surface 10*a* of the core 10 can be increased, so that it becomes possible to further increase the accuracy in the overall size of the coil component 200.

Furthermore, if the position in height where the terminal 3 protrudes outside of the core 10 and the position in height where the coil terminal portion 2 protrudes from the side surface 10*a* of the core 10 are made substantially the same, in bending of the part of the terminal 3 protruded from the side surface 10*a* and the part of the coil terminal portion 2 protruded from the side surface 10*a* along the side surface 10*a*, the above-described dislocation between the terminal 3 and the coil terminal portion 2 can be made smaller. Accordingly, it is possible to decrease the strain itself caused in the coil terminal portion 2, and thereby it can be more reliably avoided that a burden is given to the connection of the coil terminal portion 2 and the terminal 3, which is preferable.

Figure 10:
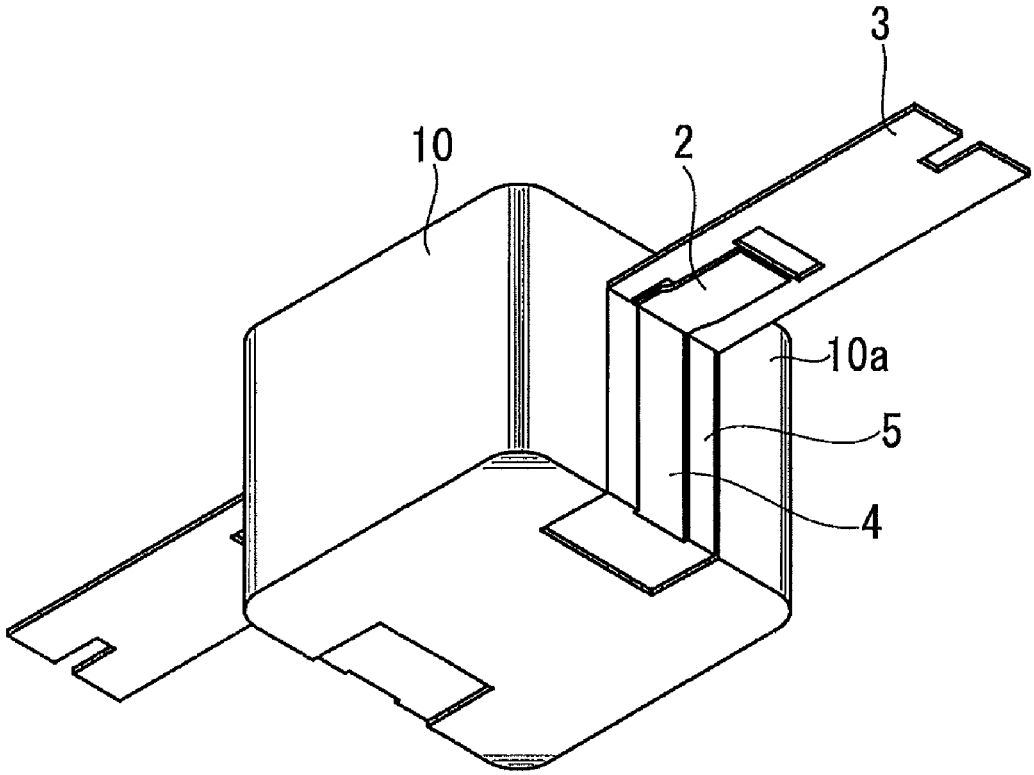
FIG. 10 is a perspective view illustrating a condition of the coil component according to the second embodiment of the present invention before a protruded part of a terminal and a protruded part of a terminal portion of a coil are bent along a side surface of a core.

In the present embodiment, as illustrated in FIG. 10, a second groove 5 is provided in the side surface 10*a* of the core 10, and a first groove 4 is provided in the second groove 5.

FIG. 10 is a perspective view when a half-finished product of the coil component 200 before the protruded part of the terminal 3 and the protruded part of the coil terminal portion 2 are bent is viewed from below.

The second groove 5 is provided in the side surface 10*a* of the core 10 below the terminal 3 which protrudes, and in the second groove 5, the first groove 4 narrower in width than the second groove 5 is provided below the coil terminal portion 2 which protrudes. Thereby, when bending the protruded part of the terminal 3 and the protruded part of the coil terminal portion 2 along the side surface 10*a* of the core 10, it is possible to accommodate the part of the coil terminal portion 2 protruded from and bent along the side surface 10*a* of the core 10 in the first groove 4 and further the part of the terminal 3 protruded from and bent along the side surface 10*a* of the core 10 in the second groove 5.

Also, the depth and width of the second groove 5 may be made larger than the thickness and width of the terminal 3 so that the protruded and bent part of the terminal 3 will not protrude from the side surface 10*a* of the core 10 even if some error occurs in bending, or the depth and width of the second groove 5 may be set such that the surface of the protruded and bent part of the terminal 3 accords with the side surface 10*a* of the core 10. When the depth and width of the second groove 3 are increased more than the thickness and width of the terminal 3, it is also possible to increase the tolerance in bending, so that bending becomes easier, and the cost can be reduced.

Thus, it becomes possible to avoid that the terminal 3 protrudes from the side surface 10*a* of the core 10 after bending of the terminal 3 and the coil terminal portion 2, and it is possible to make the side surface 10*a* of the core 10 to serve as the outermost surface of the core 10. Therefore, the coil component 200 can be provided with a stable overall size with narrow tolerance, and further it is possible to realize downsizing, which is preferable.

Note that as illustrated in FIG. 10, the second groove 5 may be provided so as to continue to the bottom surface 10*b* of the core 10 from the side surface 10*a* of the core 10. In this case, it becomes possible to accommodate the part of the protruded part of the terminal 3, which has been bent along the bottom surface 10*b* of the core 10 at the ridge line of the side surface 10*a* and the bottom surface 10*b* of the core 10, in the part of the second groove 5 continuing to the bottom surface 10*b* of the core 10. Therefore, by accommodating the part of the protruded part of the terminal 3 bent along the bottom surface 10*b* of the core 10 in the second groove 5 on the bottom surface 10*b* side of the core 10 also, the coil component 200 can be reduced in height, and further downsizing can be achieved. Further, at the part of the second groove 5 continuing to the bottom surface 10*b* of the core 10 also, by setting the depth and width of the second groove 5 greater than the thickness and width of the terminal 3, the terminal 3 can be accommodated in the part of the second groove 5 continuing to the bottom surface 10*b* of the core 10 regardless of bending accuracy, so that the accuracy in the overall size of the coil component 200 can be further improved.

3. Third Embodiment

Figure 11:
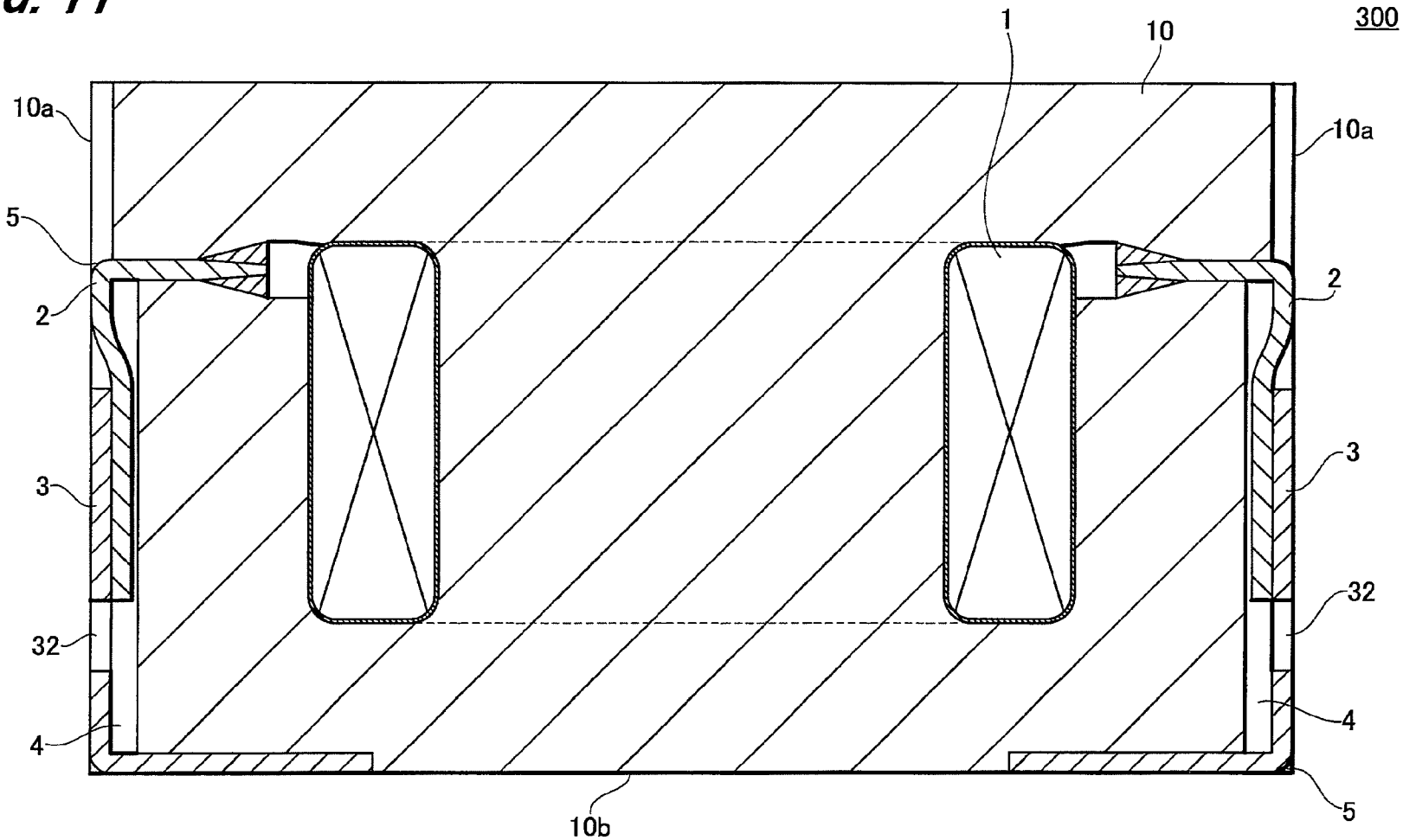
FIG. 11 is a schematic cross section illustrating a constitution of a coil component according to a third embodiment of the present invention.
Figure 12:
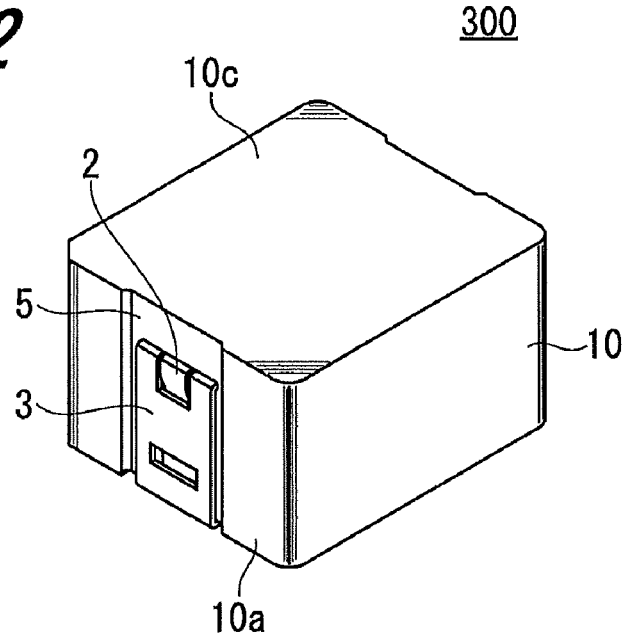
FIG. 12 is a perspective view of the coil component according to the third embodiment.
Figure 13:
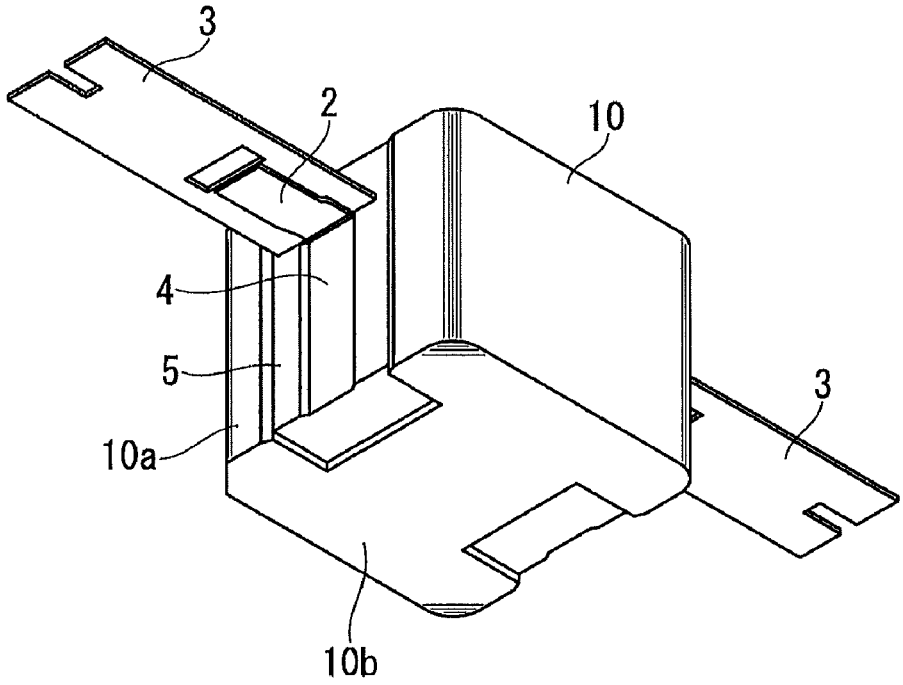
FIG. 13 is a perspective view illustrating a condition of the coil component according to the third embodiment of the present invention before a protruded part of a terminal and a protruded part of a terminal portion of a coil are bent along a side surface of a core.

FIG. 11 is a cross section of a coil component 300 according to the third embodiment of the present invention. FIG. 12 is a perspective view of the coil component 300, and FIG. 13 is a perspective view of the coil component 300 viewed from below before the protruded part of the terminal 3 and the protruded part of the coil terminal portion 2 are bent.

Note that parts corresponding to those in the second embodiment are denoted with the same symbols, and overlapped description thereof is omitted.

The coil component 300 according to the present embodiment includes the coil 1 in which a conductive wire has been wound, the core 10 formed of a magnetic material and embedding therein the coil 1, and the terminal 3 connected with the coil terminal portion 2 of the coil 1.

The above-described constitution is substantially the same as that illustrated in the second embodiment. However, in the present embodiment, the length and the width of the second groove 5 provided in the side surface of the core 10 are different from those in the second embodiment.

In the present embodiment, the width of the second groove 5 is made larger than that of the terminal 3 to give a margin in bending of the terminal 3. Further, the second groove 5 is formed so as to reach an upper surface 10*c* opposing the bottom surface 10*b* of the core 10.

In the present embodiment also, the part of the coil terminal portion 2 protruded from and bent along the side surface 10*a* of the core 10 is arranged on the backside of the part of the terminal 3 protruded from and bent along the side surface 10*a* of the core 10, i.e., between the terminal 3 and the side surface 10*a* of the core 10. Accordingly, as in the first and second embodiments, the protruded and bent part of the coil terminal portion 2 is not arranged on the front side surface of the protruded and bent part of the terminal 3, so that when bending the protruded part of the terminal 3 and the protruded part of the coil terminal part 2 along the side surface 10*a* of the core 10, it is possible to bring the jig for bending and the protruded part of the terminal 3 into surface contact with certainty.

Also, because of surface contact of the jig and the protruded part of the terminal 3, it is possible to accurately apply a force to the protruded part of the terminal 3 and the protruded part of the coil terminal portion 2, so that the protruded part of the terminal 3 and the protruded part of the coil terminal portion 2 can be bent along the side surface 10*a* of the core 10 with high accuracy, and the accuracy in the overall size of the coil component 300 can be improved. The same holds for the other effects as in the second embodiment.

Herein above, description has been made with respect to embodiments of a coil component according to the present invention. It is needless to say that the present invention is not limited to the above-described embodiments, and includes various possible configurations without departing from the scope of the present invention described in Claims.

This document claims priority and contains subject matter related to Japanese Patent Application No. 2010-102674, filed on Apr. 27, 2010, and Japanese Patent Application No. 2011-80183, filed on Mar. 31, 2011, and the entire contents thereof are herein incorporated by reference.

The invention claimed is:

1. A coil component comprising:

a core formed by a magnetic material;

a coil embedded in the core, a part of a terminal portion of the coil protruded from a side surface of the core; and a tabular terminal, apart of which protruded from the side surface of the core and partly connected with the protruded part of the terminal portion of the coil, wherein the protruded part of the terminal portion of the coil and the protruded part of the tabular terminal are respectively bent toward the bottom surface side of the core along the side surface of the core, and the protruded and bent part of the terminal portion of the coil is arranged between the protruded and bent part of the tabular terminal and the core.

2. The coil component according to claim 1, wherein a cutout is provided in an end portion of the tabular terminal on the side to be embedded in the core, and wherein the terminal portion of the coil is arranged such that a part thereof fits in the cutout.

3. The coil component according to claim 1, wherein a groove for accommodating the protruded and bent part of the terminal portion of the coil is provided in the side surface of the core from which the terminal portion of the coil protrudes.

* * * * *